US006899422B2

(12) United States Patent
Strowe et al.

(10) Patent No.: US 6,899,422 B2
(45) Date of Patent: May 31, 2005

(54) RECONFIGURABLE PANEL, ASSEMBLY, AND METHOD

(75) Inventors: Gary T. Strowe, Vancouver, WA (US); Jeffrey G. Bingham, Vancouver, WA (US); Peter G. Hwang, Vancouver, WA (US); Daniel R. Dwyer, Battle Ground, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 211 days.

(21) Appl. No.: 10/177,524

(22) Filed: Jun. 21, 2002

(65) Prior Publication Data

US 2003/0081105 A1 May 1, 2003

Related U.S. Application Data

(63) Continuation-in-part of application No. 10/014,942, filed on Oct. 26, 2001, now Pat. No. 6,557,992.

(51) Int. Cl.[7] ..... B41J 29/13
(52) U.S. Cl. ..... 347/108
(58) Field of Search ..... 347/2, 3, 108, 347/109; D18/4, 50, 55; 40/515, 591, 765

(56) References Cited

U.S. PATENT DOCUMENTS

| | | | | | |
|---|---|---|---|---|---|
| 4,544,081 | A | | 10/1985 | Voegli | |
| 4,574,934 | A | * | 3/1986 | Voegeli | 194/248 |
| 4,817,842 | A | | 4/1989 | Wilson, III | |
| 4,926,196 | A | | 5/1990 | Mizoguchi et al. | |
| 5,281,018 | A | | 1/1994 | Cullinan | |
| 5,331,758 | A | * | 7/1994 | Romick | 40/661 |
| 5,509,225 | A | * | 4/1996 | Minh et al. | 40/606.03 |
| 5,551,497 | A | * | 9/1996 | Stanley | 150/154 |
| 5,592,361 | A | | 1/1997 | Smith et al. | |
| D386,515 | S | * | 11/1997 | Sommerville et al. | D18/54.1 |
| D387,378 | S | * | 12/1997 | Sugimoto | D18/50 |
| 5,796,575 | A | | 8/1998 | Podwalny et al. | |
| D413,142 | S | * | 8/1999 | Pangburn | D18/55 |
| 6,067,738 | A | * | 5/2000 | Zeligson | 40/606.02 |
| 6,367,996 | B1 | | 4/2002 | Edwards | |
| 6,557,992 | B1 | * | 5/2003 | Dwyer et al. | 347/108 |

FOREIGN PATENT DOCUMENTS

| | | |
|---|---|---|
| EP | 1101621 | 5/2001 |
| EP | 1114731 | 7/2001 |
| FR | 2713004 | 6/1995 |
| WO | WO02/28236 | 4/2002 |

OTHER PUBLICATIONS

EPSOn America Inc., http://www.epson.com "Epson Stylus C60".

Sony New Releases, http://www.sony–asia.com/sg/news/sep00cnews4.html, "S ony Offers New Ways of Enjoying Digital Still Cameras With the New 'Cyber–shot'", Sep. 12, 2000.

Sony Website, http://www.sony.co.jp/sd/products/Consumer/popegg/printer.html, "PrintFan with Popegg".

* cited by examiner

*Primary Examiner*—Stephen D. Meier
*Assistant Examiner*—An H. Do

(57) ABSTRACT

A reconfigurable panel is provided that includes a first door and a second door having a viewing portion. In a preferred embodiment, the first door is connected to the second door and the first door and second door cooperate to form a space suitable for holding a decorative sheet between the doors, such that the decorative sheet may be viewed through the viewing portion. If desired, a user can change the appearance of the panel by changing the decorative sheet. Embodiments of an assembly and a method for reconfiguring the appearance of a panel are also disclosed.

35 Claims, 6 Drawing Sheets

RECONFIGURABLE PANEL, ASSEMBLY, AND METHOD

RELATED PATENT APPLICATION

This application is a continuation-in-part application of prior application Ser. No. 10/014,942 filed on Oct. 26, 2001, now U.S. Pat. No. 6,557,992, and adds and claims disclosure in addition to that presented in the prior application.

BACKGROUND

Devices such as peripheral devices for personal printers have become pervasive in recent years. A number of such devices are fairly uniform in appearance and are either a dull beige or gray in color. Particularly to those users who appreciate creativity and value individuality, these devices are aesthetically unpleasing and even boring.

Some device manufacturers have attempted to inject life into the appearance of their devices by producing unique versions of a particular device. For example, in 1999 Tektronix, Inc. produced a "Designer Edition" of its standard Phaser® 840 color inkjet printer. The standard 840 printer utilized an ordinary beige molded plastic housing. The "Designer Edition", however, featured an eye-catching icy blue transparent housing and was designed to match a Power Macintosh® G3 computer which had a similar transparent blue housing.

A drawback with producing unique or "designer" versions of such devices is that each version commonly requires separate case parts, nonstandard materials, unique painting and/or other expensive modifications. Additionally, each specially designed version of a device will likely appeal to only a subset of the potential market for the device and cannot be easily reconfigured by the user.

Among other things, it may be desirable to provide a device with panels or doors that may be modified, customized, decorated, or otherwise easily reconfigured by a user. It may further be desirable to provide a relatively simple and inexpensive method for creating and changing the appearance of such panels or doors, as well as for related assemblies.

DETAILED DESCRIPTION OF THE PREFERRED EMBODIMENTS

Figure 1:
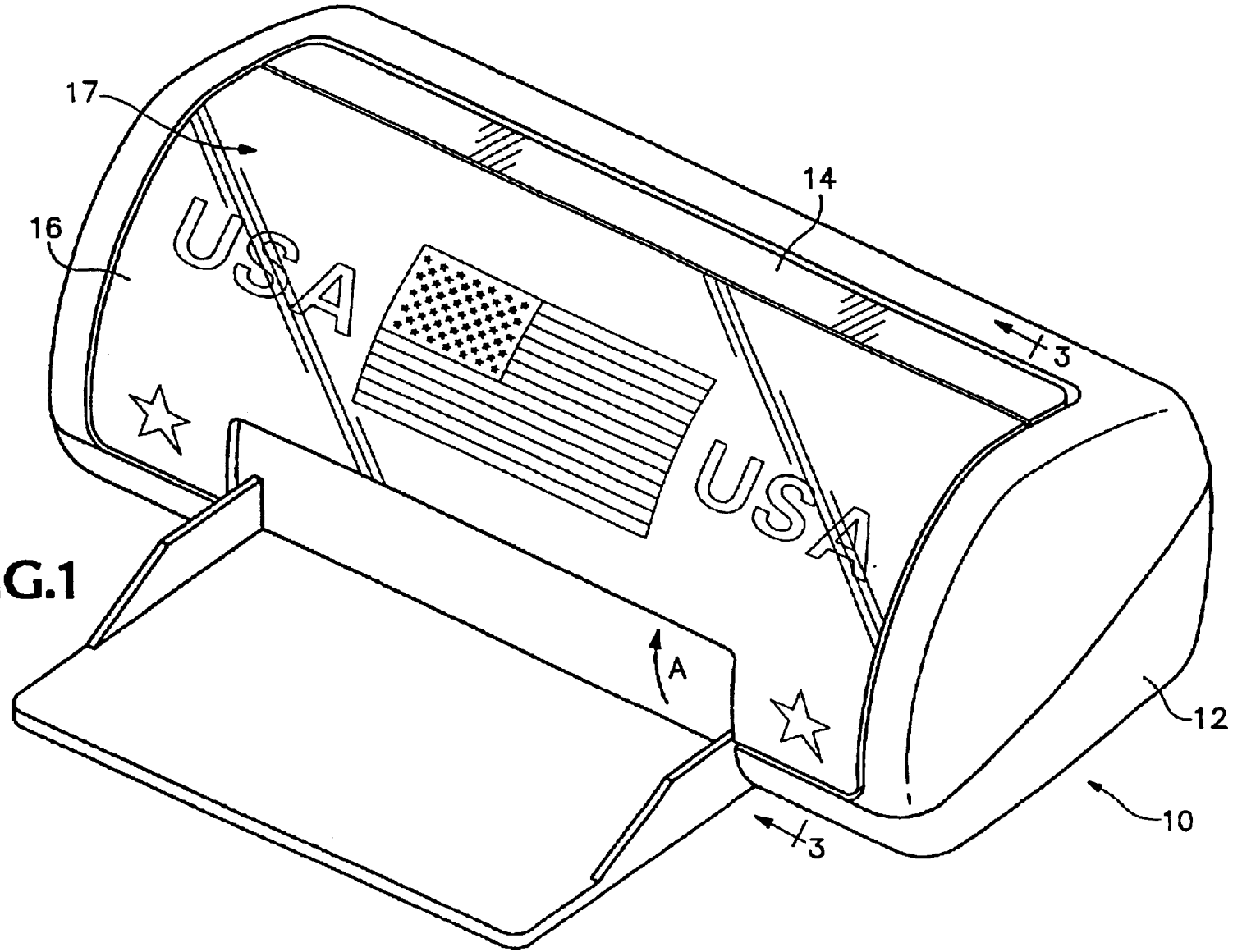
FIG. 1 is a perspective view of an embodiment of the invention.

FIG. 1 illustrates an embodiment of a device 10, such as an inkjet printer, that may be constructed according to an embodiment of the present invention. It will be appreciated that other embodiments of the invention may be embodied in and/or practiced in connection with various other types of devices or assemblies having panels (such as access panels), covers or doors. Such devices may include, without limitation, electrophotographic printers, fax machines, multi-function devices, copiers, video printers, scanning devices and the like.

An illustrative device 10 includes a body portion or housing 12 that is preferably made of a plastic material. A housing 12 covers at least a portion of the associated device and, more preferably, covers or substantially encloses the operative components of the device. For example, without limitation, with an inkjet printer, the enclosed components may include an inkjet printhead mounted on a reciprocating carriage, a media handling system and a controller and other electronics for controlling the operation of the printhead, carriage and media handling system (not shown).

Figure 2:
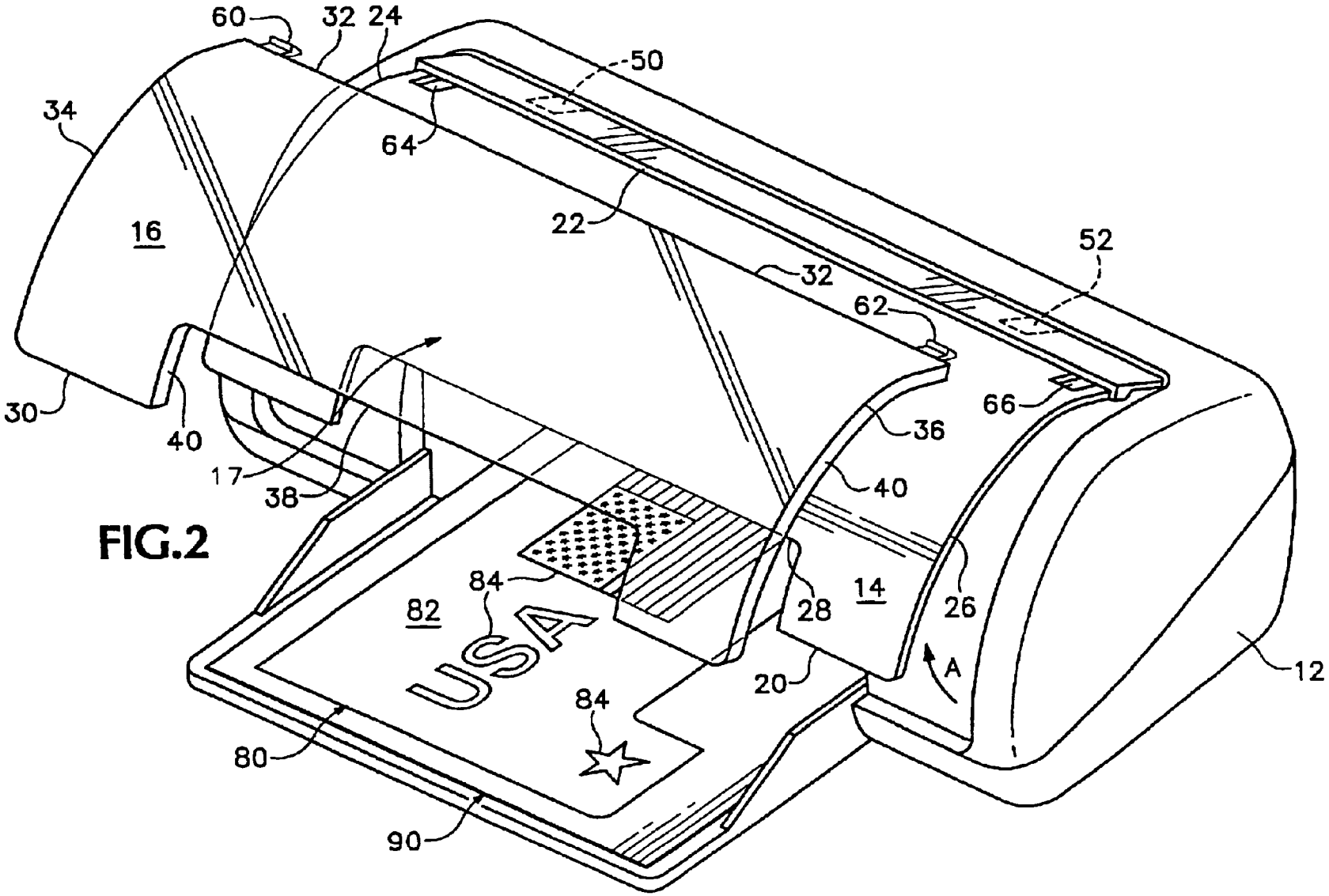
FIG. 2 shows an exploded view of the device of FIG. 1 with a decorative sheet being printed by the device.

As shown in FIGS. 1 and 2, a panel 11 of an associated device 10 includes a first door 14 and a second door 16. In a preferred embodiment of the invention, the first door 14 is attached or connected to the device 10 and at least partially covers an opening or other portion to be covered that is associated with the device. However, it is to be understood that the panel 11 is not necessarily limited to covering openings or apertures, and may also be included with a device or assembly for other purposes—such as protecting or covering module panels, storage compartments, switches, buttons, or other components.

First door 14 can be formed from a wide variety of materials. In a preferred construction, the first door 14 is comprised of a plastic or polymer. Acceptable materials used to form the first door 14 include, but are not limited to, styrenic resins such as ABS or high-impact polystyrene.

In a preferred embodiment, the first door serves as an "inner" door (with respect to the outer door 16) and includes a front edge 20, a rear edge 22 opposite the front edge, a left edge 24 and a right edge 26 opposite the left edge. If desired, an edge (e.g., the front edge 20) may further include a notched or cutaway portion 28, such as a cutaway portion 28 that defines an opening for media or other items to travel into and out of the housing 12.

The second door 16 serves as an "outer" door (with respect to first door 14) and includes a viewing portion 17 on a face surface 18. The face surface 18 preferably comprises the entire surface of the outer door 16 that "faces" or is viewed by an observer when the first and second doors 14,16 are connected. In a preferred embodiment, the viewing portion 17 is substantially rigid and clear and comprises a majority of the face surface 18 of the second door 16. If desired, the viewing portion of the second door 16 may comprise all or substantially all of the face portion 18 of the second door 16 or may include one or more smaller viewing portions on the face portion 18, such as one or more smaller "windows" or clear framed portions of the face surface 18. For instance, it is possible to include several viewing portions that mimic picture frames. As used herein, the term "clear" is meant to describe a level of clarity that permits a user to view or observe at least a portion of a design or other visual feature or ornamentation covered by or positioned behind the viewing portion 17. In a similar context, the term "substantially rigid" is intended to refer to a physical structure that substantially retains its shape under normal operating conditions.

The second door 16 can also be formed from a wide variety of materials. However, the second door 16 is preferably formed from material that is capable of providing the necessary or desired clarity and/or structural functionality for an associated application. In a preferred embodiment, the second door 16 is comprised of a plastic or polymer, and more preferably is comprised of a polycarbonate; an acrylic; or a styrenic resin—such as ABS, styrene-acrylonitrile (SAN), or polystyrene. Preferably, the materials forming the second door 16 provide a desired or acceptable level of characteristics, such as strength, toughness, viewing clarity, durability, and/or heat-resistance properties. For instance, for certain applications, it is desirable to form the viewing portion 17 to be as "glass-like" as possible. For other applications, the viewing portion 17 of the second door 16 may be frosted or designed to be somewhat opaque.

In a preferred embodiment, the second door 16 includes a front edge 30, a rear edge 32 opposite the front edge, a left edge 34 and a right edge 36 opposite the left edge. If desired, an edge (e.g., the front edge 30) may include a notched or cutaway portion 38 that substantially corresponds to a cutaway portion 28 of the first door 14 and may define an opening for media or other items to travel into and out of an associated housing 12.

Preferably, the first door 14 and the second door 16 have a similar shape over at least a portion of their surfaces, and more preferably, over substantially all of the face surface 18 or viewing portion 17 of the second door 16. For example, in an embodiment such as that illustrated, the second door 16 has a curved portion and the first door 14 includes a curved portion that substantially matches or corresponds to the curved portion of the second door 16.

Figure 3:
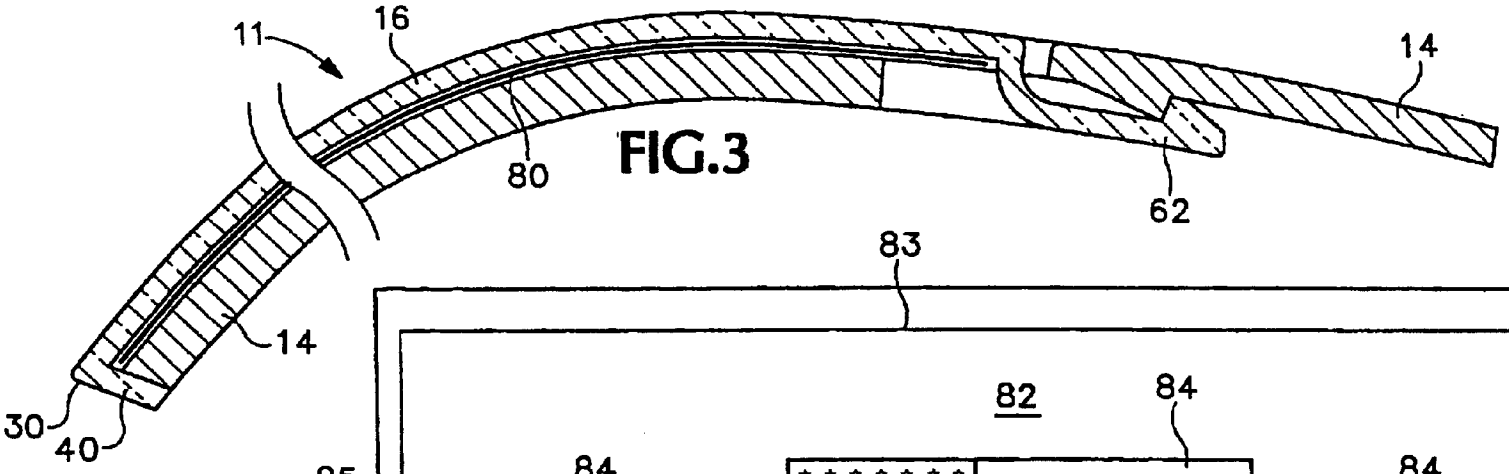
FIG. 3 is a sectional view taken along line 3—3 of FIG. 1 showing the first door, the decorative sheet and the second door.

With reference to FIGS. 2 and 3, second door 16 may include a flap or lip 40 that protrudes inwardly in the direction of the curvature of the second door. As shown in the embodiment, the lip 40 may extend substantially along the front edge 30, the left edge 34 and the right edge 36 of the second door 16. If desired, the lip 40 can be configured to releasably secure the first door 14 adjacent to the second door 16. Further, either door may include a formation, such as a lip, a ledge or similar feature for retaining, supporting, or orienting an object (e.g., a sheet) in position between the doors.

FIG. 1 shows an embodiment of the invention in the form of an assembly with the first door 14 and second door 16 assembled to form a panel 11 on housing 12. Should a user require access to components inside the housing 12, the panel 11 may, for instance, be rotated upwardly in the direction of action arrow A. FIG. 2 also shows the first door 14 partially rotated upwardly. In this embodiment, the first door 14 is rotatably coupled to the housing 12 by a first hinge 50 and a second hinge 52. The invention is not, however, limited to such a specific configuration. Instead, a number of additional forms of connections between the first door 14 and the second door 16, as well as the connection of the first door 14 (and/or the second door 16) to the housing 12, are contemplated.

Doors 14,16 are preferably attached or connected to each other at one or more positions in proximity to one or more ends or edges. For example, without limitation, doors 14,16 may be connected or attached at (or in proximity with) corresponding respective edges. For example, the doors 14,16 may be connected or attached at (or in proximity with) their respective front edges; their respective front edges and rear edges; or various other combinations of corresponding edges. In an embodiment, the second door 16 may be "snapped" together or otherwise releasably connected with the first door 14 at both their respective front and rear edges.

Figure 5:
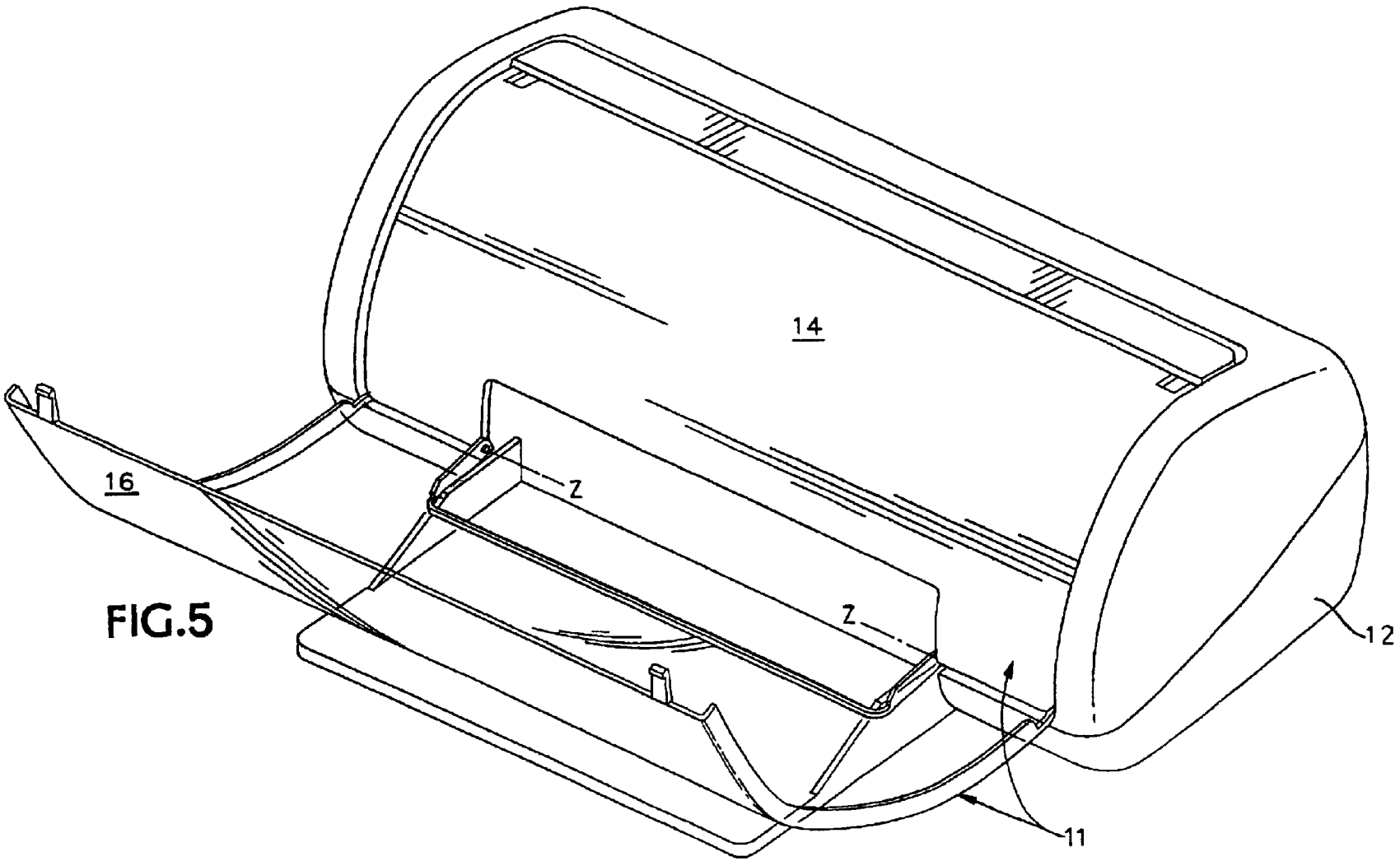
FIG. 5 is a perspective view of an assembly including another embodiment of the invention.

FIG. 5 depicts an embodiment of a panel 11 connected to a device 10 to form an assembly. The panel 11 includes a first door 14 and a second door 16, and is shown with the second door 16 in an "open" position relative to the first door 14. Preferably, the doors 14,16 of the panel 11 are connected and the panel 11 is further connected to a device. In a preferred embodiment, panel 11 is connected to the device 10 so that the doors 14,16 can be partially separated or "parted" from each other (e.g., for inserting a decorative sheet), while the doors 14,16 remain at least partially connected and without requiring the complete separation or disassembly of the doors from one another, or from an associated device 10.

Figure 6:
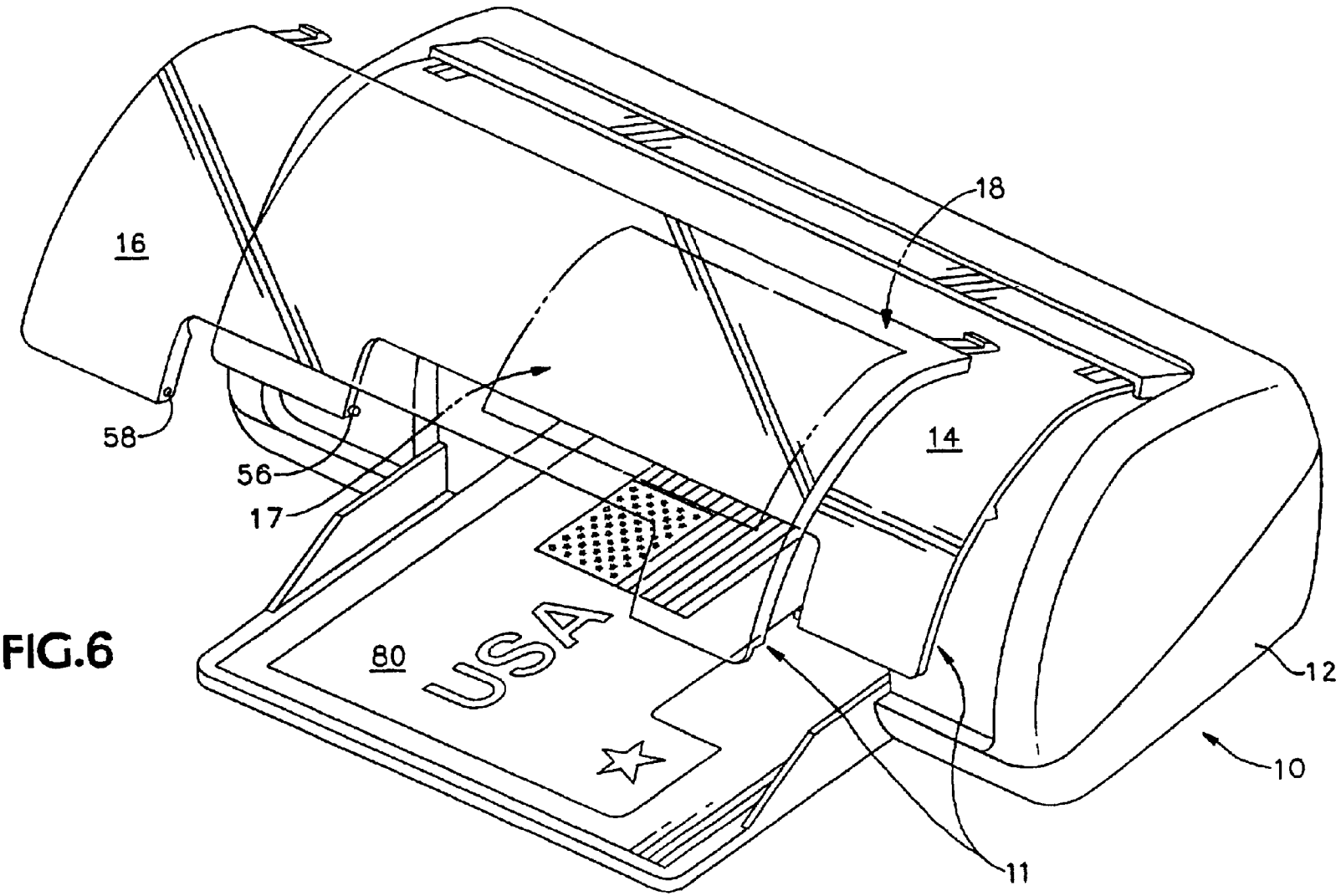
FIG. 6 is a perspective view of an assembly similar to that shown in FIG. 5 with a partially disassembled panel.

FIG. 6 is an illustration of an assembly, similar to that shown in FIG. 5, wherein the second door 16 is shown physically separated from the first door 14 and, which. in turn, is shown with the second door 16 partially separated from the device 10.

The doors 14,16 are preferably releasably secured to one another. If desired, the first door 14 may be configured to be separated from a device 10 by "unlatching" or releasing the attachment of an "upper" or rear edge portion of first door 14 from a corresponding portion of a device 10 and rotating the rear edge portion of the first door 14 upwardly away from the device, for example, in the direction shown by arrow A in FIG. 1. Moreover, if desired, the second door 16, which preferably is connected or attached to the first door 14 at (or in proximity) to the opposite end of the first door 14 connected to the device 10, may be rotated downwardly away from the first door 14 in a rotational direction of action opposite to that of the first door 14 relative to the device 10.

Figure 8:
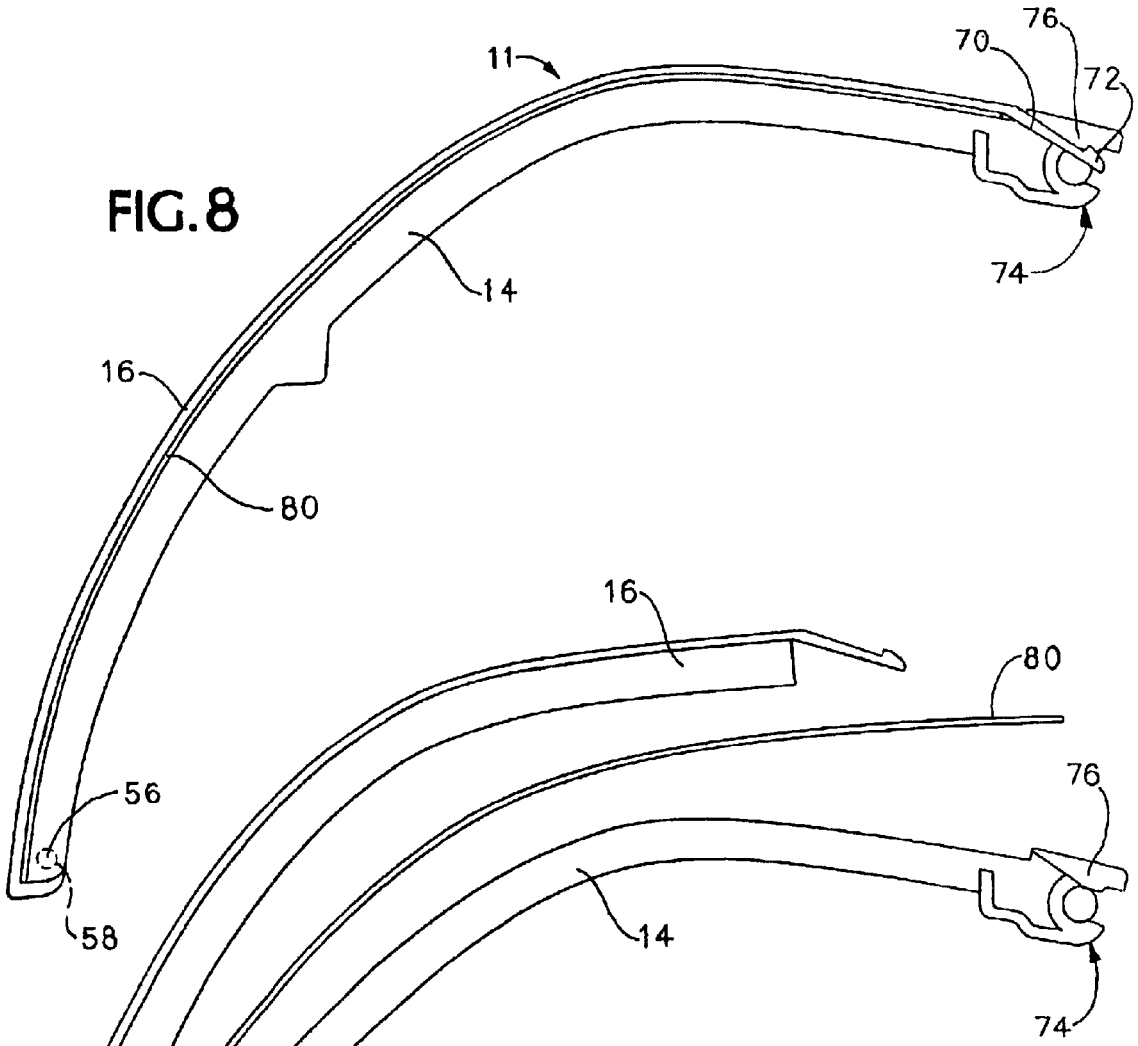
FIG. 8 is a cross sectional view of an embodiment of a panel shown with a decorative sheet in an "closed" configuration.
Figure 7:
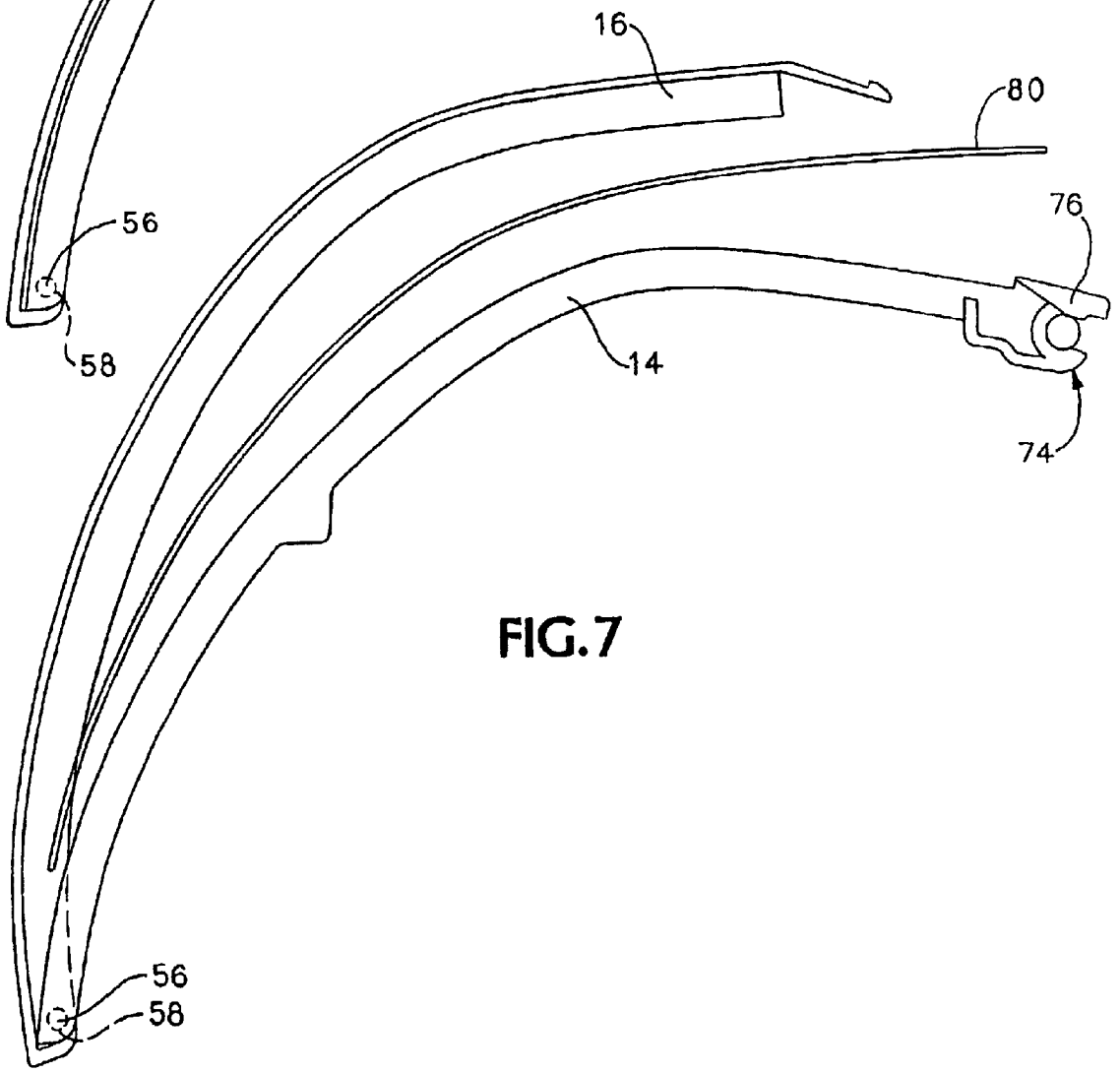
FIG. 7 is a cross sectional view of an embodiment of a panel shown with a decorative sheet in an "open" configuration.

FIGS. 7 and 8 illustrate a cross section of an embodiment of a panel 11. The panel 11, along with a decorative sheet 80, is shown in the "open" and "closed" (i.e., assembled) positions, respectively. In a preferred embodiment, the first door 14 and second door 16 are rotatively or otherwise releasably or flexibly connected to one another at a common end (shown in proximity to the front edges 20,30 of doors 14,16).

As illustrated in FIGS. 7 and 8, the doors 14,16 may be connected in a pin-hole configuration and may each rotate (to the same or a slightly different degree) about a substantially common axis Z. As additionally illustrated in FIGS. 5 and 6, the first door 14 may include an integrally-formed, protruding attachment formation, such as a pin 56, and the second door may include a corresponding attachment formation, such as an aperture or hole 58. However, the configuration could also be modified, for example, such that a pin 56 is included or formed as part of the second door 16 and a corresponding hole 58 is formed with the first door 14.

In a preferred embodiment, such as illustrated in FIG. 7, the upper portion of second door (or portion of the doors opposite the pin-hole connection) may include a formation (such as a clip or tab) 70, which may further include an end formation 72 (such as a rib). The first door 14 preferably includes a corresponding receiving formation 74 for releasably receiving and retaining the formation 70, and may further include a contact formation 76 for releasably connecting with end formation 72.

To provide additional protection to a sheet or other object inserted between the doors. 14,16, such as from exposure to air or other elements, the doors are preferably connected to form at least a partial sealing engagement around the space formed therebetween. For example, without limitation, the sealing engagement may be accomplished by a taper-formed, taper-lock, or other semi-seal/integrated interconnection between surfaces of the first and second doors.

Moreover, a surface of one or more doors that form the sealing engagement may also be used to partially support a sheet or other object in position between the doors. In a preferred embodiment, the seal created with respect to the space created between the doors 14,16 will substantially cover the majority of the sides of an associated media or sheet.

While the connection between the doors 14,16 may be of the configurations illustrated in FIGS. 5–8, the connection between the doors 14,16 is not limited to a specific manner of attachment/connection or the use of a single manner of attachment or connection with a single panel 11. Moreover, a connection between the doors 14,16 (or between the panel 11 and device 10) may be configured using both integrally-formed and non-integral components and a variety of methods for attachment or connection, including, without limitation, a pin-hole structural connection, an extension-fit connection, a snap-fit or snap-lock connection, a ridge-press fit connection, or various other types of connectors for connecting plastic components.

As explained in more detail below, a decorative sheet 80 can be positioned between the first door 14 and the second door 16 to customize the appearance of the panel 11 and, if present, a corresponding device or assembly. In the embodiments illustrated, the second door 16 is preferably releasably secured to the first door 14 to allow a user to easily change the decorative sheet 80. For example, as shown in FIGS. 2 and 3, the second door 16 may include a first tab 60 and a second tab 62 that can be releasably press fit into a corresponding first slot 64 and second slot 66, respectively, in the first door 14. Similarly, as shown in FIGS. 5–8, the second door can be attached using different types of connectors in a different manner to provide a similar display with respect to the viewing portion 17 and a sheet 80. Advantageously, a user may change or customize the appearance of the panel 11, by simply decoupling or partially separating the second door 16 from the first door 14, removing the decorative sheet 80 (if present), and inserting a different decorative sheet.

Figure 4:
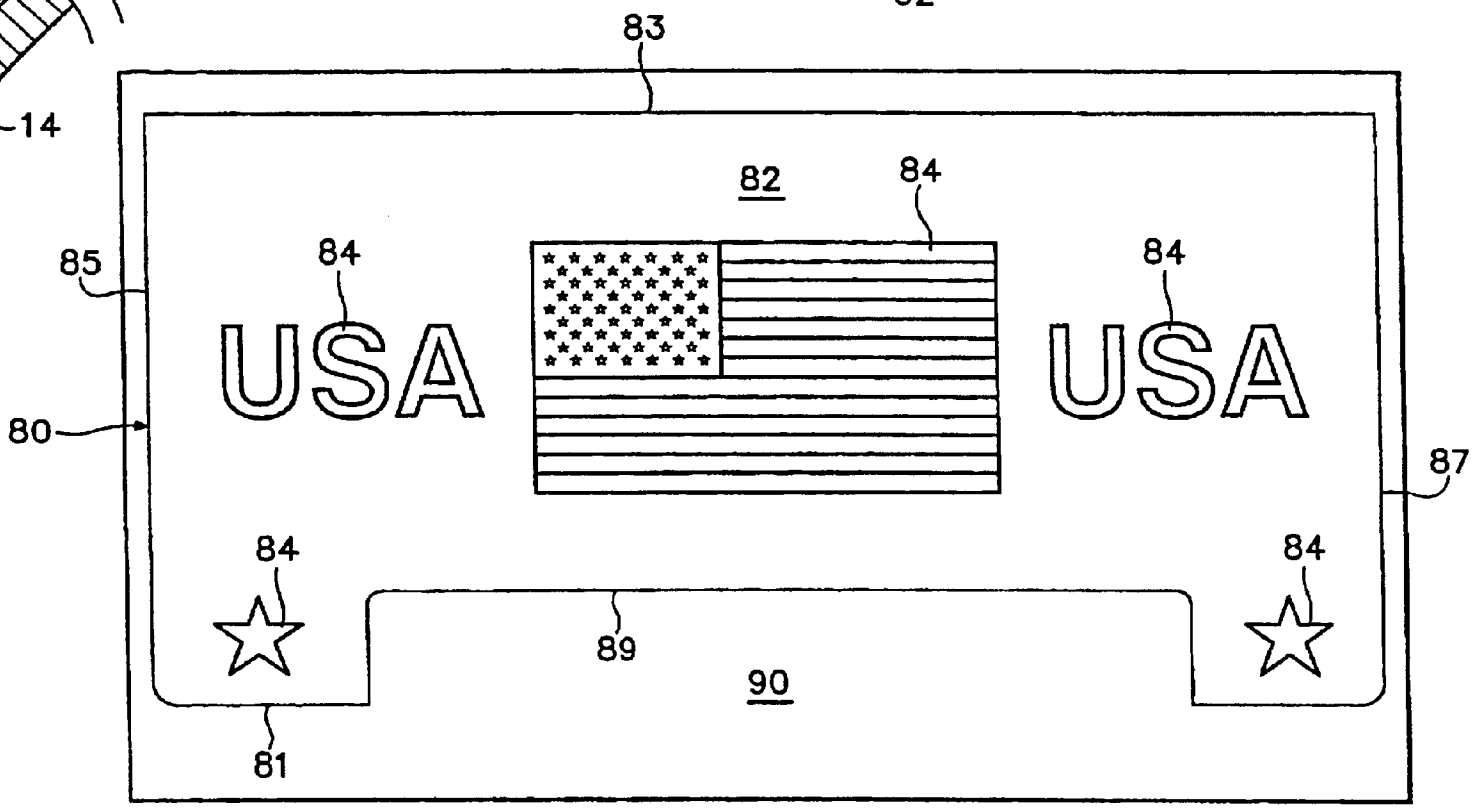
FIG. 4 is a plan view of an embodiment of the decorative sheet embodied on a media sheet.

With reference now to FIG. 4, a sample decorative sheet 80 is shown that includes a top surface 82 with a visible decoration 84. It will be appreciated that a variety of decorations may be used on the decorative sheet 80, such as artwork, images, photographs, drawings, etc. For example, as shown in FIG. 1, but without limitation, the decorative sheet 80 may be installed in a panel 11 connected to a device 10. In a preferred embodiment, the sheet 80 can be inserted so that the top surface 82 of the sheet 80 is adjacent to the second door 16 and, depending upon the desired configuration, all or a portion of the decoration 84 may be positioned to be visible through a viewing portion 17 of the second door 16. For example, a user may decorate a device 10 by placing a decorative sheet 80 behind the a transparent viewing portion 17 of a second door 16 and orienting the top surface 82 to be adjacent to the second door.

In a preferred embodiment, the overall shape of the decorative sheet 80 substantially corresponds to the shape the second door 16 when the decorative sheet is installed behind the door 16, for example, as shown in FIGS. 1 and 3. Moreover, the length of the sheet 80 is, preferably, approximately equal to the width of the second door 16. In other embodiments, the distance between the left border of the decorative sheet and the right border of the decorative sheet is substantially equal to a distance between the left edge of the second door and the right edge of the second door.

In an embodiment such as illustrated in FIG. 4, the decorative sheet 80 includes a front border 81, a rear border 83 opposite the front border, a left border 85 and a right border 87 opposite the left border. Preferably, the distance between the front border 81 and the rear border 83 is substantially equal to the distance (e.g., along the curvature) of the viewing portion 17 of the second door 16 between the front edge 30 of the second door 16 and the rear edge 32 of the viewing portion 17 of the second door 16. Also preferably, the distance between the left border 85 of the decorative sheet 80 and the right border 87 of the decorative sheet is substantially equal to the distance between the left edge 34 of the viewing portion of the second door 16 and the right edge 36 of the viewing portion 17 of the second door. If desired, the second door 16 may also include a cutaway portion 38 that defines an opening for media travel, for example, into and out of the housing 12. With further reference to FIG. 4, the decorative sheet 80 may include a cutaway portion 89 along the front border 81 that substantially matches or corresponds to the cutaway portion 38 in the second door 16.

As described above, the second door 16 may include a lip 40 that protrudes inwardly in the direction of the second door. In one embodiment, the lip 40 extends substantially along the front edge 30, left edge 34 and right edge 36 of the second door 16. With reference to FIG. 3, the lip 40 may serve to releasably seat the decorative sheet 80 adjacent to the second door 16.

In a preferred embodiment of the assembly, the decoration 84 may be printed on the top surface 82 of the decorative sheet 80 by the device 10. In another aspect of the present invention, multiple or different decorations may be provided on a memory device, such as a CD-ROM, and selected by the user for printing on the decorative sheet 80. A user may also download decorations from a remote content source, such as a content provider on the Internet. A user may also design a custom decoration and print that decoration on the decorative sheet 80 with the device 10. Alternatively, a user may utilize pre-printed decorative sheets that are separately provided (e.g., purchased) or provided with the device 10.

The decorative sheet 80 illustrated in FIG. 4 is shown as part of a larger media sheet 90. In another aspect of the present invention, a user may print the decoration 84 within a predetermined area of the media sheet 90, the predetermined area forming an outline of the decorative sheet 80. In one embodiment, printing the decoration 84 includes printing an outline or cutting guide on the media sheet that outlines the decorative sheet 80. Alternatively, the cutting guide may be pre-printed on the media sheet 90. A user may then cut along the cutting guide to separate the decorative sheet 80 from the media sheet.

In another embodiment, the media sheet 90 may include perforations that outline the decorative sheet 80. A user may print the decoration 84 within a predetermined area that is formed by the perforations and outlines the shape of the decorative sheet 80. The user may then separate the decorative sheet 80 from the media sheet 90.

Another embodiment of the invention includes a method for reconfiguring a panel 11 comprising: providing a panel 11 that includes a first door 14 and a second door 16 with a viewing portion 17; providing a decorative sheet 80; positioning the sheet 80 between the first door 14 and the second door 16, wherein a portion of the sheet 80 is visible through the viewing portion 17 of the second door 16; and connecting the first door 14 to the second door 16 to retain and/or orient the sheet 80 between the first door 14 and the second door 16. Where a corresponding device 10 is included with the assembly, the panel 11 can then be releasably connected to the device. Further, it is possible to have the sheet 80 created, generated, or partially modified by the device that it is to be associated with and to have a decoration that is generated by software. Moreover, software may configure and/or orient the appearance generated on the sheet 80 to be viewed through the viewing portion 17 of the second door 16.

It is apparent that a variety of other, equivalent modifications and substitutions may be made to the apparatus and method of the present invention according to the concepts covered herein, depending upon the particular implementation, while still falling within the scope of the claims below. While the present invention has been particularly shown and described with reference to the foregoing preferred and alternative embodiments, it should be understood by those skilled in the art that various alternatives to the embodiments described herein may be employed in practicing such embodiments of the invention without departing from the spirit and scope of the invention defined in the following claims. This description of embodiments of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

What is claimed is:

1. A panel comprising:

a first door; and a second door including a face surface having a viewing portion, the first door being connected to the second door; and wherein the first door and second door form a space between the first door and the second door to hold at least a portion of a sheet, wherein the panel is on a printer and the sheet is printed with printer.

2. A panel as recited in claim 1, wherein the viewing portion of the second door is substantially clear, frosted, or opaque.

3. A panel as recited in claim 2,wherein the viewing portion comprises substantially the entire face surface of the second door.

4. A panel as recited in claim 1, wherein the face portion includes a plurality of viewing portions.

5. A panel as recited in claim 1, wherein the second door is substantially rigid and comprised of a polymer.

6. A panel as recited in claim 1, wherein the first door includes a connection formation for connection to a corresponding connection formation of the second door.

7. A panel as recited in claim 6, wherein the connection formation includes a pin, a hole, a tab, an extension, a ridge, a press-fit feature, a hook or a snap.

8. A panel as recited in claim 1, wherein a portion of the first door is releasably connected to a portion of the second door.

9. A panel as recited in claim 1, wherein the second door and the first door include curved segments.

10. A panel as recited in claim 1, wherein the panel includes a formation for engaging a portion of a device.

11. A panel as recited in claim 1, wherein the first door and second door are connected to permit substantially coordinated rotation about an axis.

12. A panel as recited in claim 1, wherein the first door and the second door are connected to include at least a partial sealed engagement about the space formed by the first door and the second door.

13. A panel as recited in claim 12, wherein the sealed engagement includes a taper-lock interconnection between the first door and second door.

14. A panel as recited in claim 13, wherein the sealed engagement at least partially forms a support formation.

15. A panel as recited in claim 1, wherein the first door and second door include notches.

16. A panel as recited in claim 1, including the sheet positioned between the first door and second door.

17. A panel as recited in claim 16, wherein the portion of the sheet is at least partially visible through the viewing portion of the second door.

18. A panel as recited in claim 16, wherein the first door and second door are connected below the sheet and further are releasably connected above the sheet, on one side of the sheet, or on both sides of the sheet.

19. A panel as recited in claim 18, wherein the first door and the second door at least partially seal the sheet from exposure to ambient conditions.

20. A panel as recited in claim 16, wherein the first door and the second door include notches.

21. A panel comprising:

a first door; and a second door comprised of a polymer, the second door including a connection end and a substantially rigid and clear viewing portion, the first door being rotatively connected to the connection end of the second door; and a sheet having a top surface and including a decoration, the sheet being positioned between the first door and the second door, the decoration being at least partially visible through the viewing portion of the second door, wherein the panel is on a printer and the sheet is printed with printer; and wherein the first door and second door are connected to at least partially seal the sheet from ambient conditions.

22. A panel comprising:

a first door; and a second door including a viewing portion, wherein the first door includes a means for connecting the first door to the second door and further wherein the first and second door include a means for positioning a sheet between the viewing portion of the second door and the first door; and wherein the panel is on a printer and the sheet is printed with printer.

23. A device comprising:

a body portion including a portion to be covered; and a panel for covering the portion to be covered, the panel including a first door and a second door having a viewing portion;

wherein the first door and second door are cooperatively connected to form a space between the first door and second door to hold a sheet; and wherein the sheet is printed with the device.

24. A device as recited in claim 23, wherein the panel includes a connector for connection to the body portion.

25. A device as recited in claim 24, wherein the connector is formed integrally with the first door or second door.

26. A device as recited in claim 25, wherein the connector includes a formation and the body includes a receiving portion for the formation.

27. A device as recited in claim 23, wherein the panel includes a means for releasably connecting the panel to the body portion.

28. A device as recited in claim 23, including a sheet positioned between the first door and the second door, wherein a portion of the sheet is at least partially visible through the viewing portion of the second door.

29. A device as recited in claim 28, wherein first door and second door form at least a partial seal around the sheet.

30. A method comprising:

providing a panel including a first door and a second door with a viewing portion;

printing a sheet with the device;

positioning the sheet between the first door and the second door, wherein a portion of the sheet is visible through the viewing portion of the second door; and connecting the first door to the second door to retain the sheet between the first door and the second door.

31. A method comprising:

providing a device with a body portion and a panel including a first door and a second door with a substantially rigid viewing portion;

printing a sheet with the device;

positioning the sheet between the first door and the second door, wherein a portion of the sheet is visible through the viewing portion of the second door;

connecting the first door to the second door to retain the sheet between the first door and the second door; and connecting the panel to the body portion of the device.

32. A method as recited in claim 31, including having the sheet modified to fit the space provided between the first door and the second door.

33. A method as recited in claim 32, wherein the sheet includes removal lines or perforations identifying a portion of the sheet to be removed.

34. A method as recited in claim 31, wherein the appearance of the sheet is generated by software.

35. A method as recited in claim 34, wherein the software controls the appearance generated on the sheet that is viewed through the viewing portion of the second door.

* * * * *

UNITED STATES PATENT AND TRADEMARK OFFICE

CERTIFICATE OF CORRECTION

PATENT NO. : 6,899,422 B2
APPLICATION NO. : 10/177524
DATED : May 31, 2005
INVENTOR(S) : Gary T. Strowe et al.

It is certified that error appears in the above-identified patent and that said Letters Patent is hereby corrected as shown below:

In column 8, line 12, in Claim 16, after "including" delete "the" and insert -- a --, therefor.

In column 8, line 14, in Claim 17, after "wherein" delete "the" and insert -- a --, therefor.

In column 8, line 65, in Claim 26, delete "claim 25" and insert -- claim 24 --, therefor.

Signed and Sealed this

Fifteenth Day of December, 2009

David J. Kappos

David J. Kappos
*Director of the United States Patent and Trademark Office*